US005096778A

United States Patent [19]

Andrews, Jr. et al.

[11] Patent Number: 5,096,778

[45] Date of Patent: Mar. 17, 1992

[54] DIP PENETRATION REGULATORS FOR TIRE YARNS

[75] Inventors: Walter R. Andrews, Jr., Richmond, Va.; Fleming H. Day, Greenville, N.C.

[73] Assignee: E. I. Du Pont de Nemours and Company, Wilmington, Del.

[21] Appl. No.: 435,828

[22] Filed: Nov. 9, 1989

Related U.S. Application Data

[60] Division of Ser. No. 224,209, Jul. 22, 1988, Pat. No. 4,900,496, which is a continuation of Ser. No. 911,678, Sep. 26, 1986, abandoned.

[51] Int. Cl.[5] ..... B32B 27/34; D02G 3/00

[52] U.S. Cl. ..... 428/395; 57/241; 57/250; 57/902; 428/375

[58] Field of Search ..... 57/241, 248, 250, 295, 57/902; 428/375, 378, 394, 395

[56] References Cited

U.S. PATENT DOCUMENTS

| | | | |
|---|---|---|---|
| 2,385,890 | 10/1945 | Spanagel | 18/54 |
| 2,436,978 | 3/1948 | Standley et al. | 57/140 |
| 2,436,979 | 3/1948 | Standley | 57/140 |
| 3,113,369 | 12/1963 | Barrett et al. | 28/75 |
| 3,279,943 | 10/1966 | Skeen et al. | 117/138.8 |
| 3,311,691 | 3/1967 | Good | 264/290 |
| 3,503,880 | 3/1970 | McMicken | 252/8.75 |
| 3,610,311 | 10/1971 | Simons | 152/359 |
| 3,669,726 | 6/1972 | Tinder | 117/138.8 |
| 3,704,160 | 11/1972 | Steinmiller | 117/138.8 |
| 3,785,973 | 1/1974 | Bernholz et al. | 252/8.8 |
| 4,451,382 | 5/1984 | Childers | 252/8.6 |

FOREIGN PATENT DOCUMENTS

| | | |
|---|---|---|
| 50-5475 | 1/1975 | Japan . |

*Primary Examiner*—Lorraine T. Kendell

[57] ABSTRACT

A polyamide yarn having on the surface of the polyamide yarn a hydrophobic organic ester dip penetration regulator having a melting point greater than 27° C. and convertible by conventional means into a tire cord having low stiffness and high air permeability and a process for making polymeric tire yarns is disclosed.

5 Claims, No Drawings

DIP PENETRATION REGULATORS FOR TIRE YARNS

This is a division of application Ser. No. 07/224,209, filed July 22, 1988, now U.S. Pat. No. 4,900,496, which is a continuation of U.S. Ser. No. 06/91,678, filed Sept. 26, 1986, now abandoned.

TECHNICAL FIELD

This invention relates to a polyamide yarn having on the surface of the polyamide yarn hydrophobic organic ester dip penetration regulator having a melting point greater than 27° C. and convertible by conventional means into a tire cord having low stiffness and high air permeability and a process for making polymeric tire yarns.

BACKGROUND

Fiber finishes having hydrophobic organic ester components, with a melting point lower than ambient temperature, have been used by fiber producers because of their ease of handling at ambient temperature. These liquid esters provide lubrication to the fiber during spinning, plying, twisting, and fabric weaving operations. Unfortunately, these liquid lubricants tend to promote excessive stiffness in resorcinol-formaldehyde-latex (RFL) treated cords. This stiffness causes handling problems in tire manufacturing and it is accompanied by low air permeability of RFL dipped cord which causes excessive curing blows in tires.

Triglyceride ester lubricants used in commercial finishes are examples of stiffness-promoting finish ingredients. Examples of such esters are transesterified triglyceride made from glyceryl trioleate, coconut oil and palm oil and having a melting point of approximately 21° C. and coconut oil with a melting point of approximately 24°-27° C.

It is especially important for tire cords not to have excessive stiffness or poor air permeability, the cause of which is believed to be excessive dip penetration into the tire cord. The object of this invention is to develop a tire yarn convertible to a tire cord, said cord having low stiffness and high air permeability and a process for making such tire yarn.

High dipped cord stiffness can be reduced by mechanically exercising fabrics during the fabric hot stretching process. For example, fabrics can be passed over breaker or flexing bars under relatively high tensions to physically break apart stuck filaments to reduce dipped cord stiffness. However , this is undesirable in that some dip is removed and fabrics may be damaged. Furthermore, mechanical fabric treatments do not increase dipped cord permeability.

Fabric hot stretching temperatures and tensions can influence dipped cord air permeability, but it is difficult to significantly increase air permeability without adversely affecting other properties such as adhesion. Curing blows caused by low air permeability dipped cords can be reduced by using lower temperature, longer tire curing cycles, but this increases tire manufacturing cost.

Excessive dipped cord stiffness can cause several problems in tire building, including difficulty in making tight uniform turn-ups and excessive trapped air which aggravates curing blows in tires. It is physically more difficult to turn carcass fabric plies around the bead, causing operator discomfort. Even when plies are turned up automatically, there is a tendency for turn-ups to come loose. Low air permeability leads to excessive curing blows in tires. Invariably some air is trapped between components as tires are assembled. If this air collects in pockets during the tire curing process, air bubbles result in the cured tire, and the tire must be rejected.

SUMMARY OF THE INVENTION

A polyamide yarn suitable for use as a tire yarn characterized by a tenacity of greater than 9 g/den., a copper content of greater than 40 parts per million and having on the surface of the polyamide yarn at least 0.05% based on the weight of the polyamide yarn hydrophobic organic ester dip penetration regulator, preferably pentaerythritol tetralaurate or hydrogenated coconut oil, having a melting point greater than 27° C. and convertible by conventional means into a tire cord having an air permeability as measured by wicking of at least 0.4 liter/30 min., preferably 0.7 liter/30 min. and preferably a stiffness of less than 40 grams, more preferably less than 30 grams has been discovered. An ethoxylated nonionic surfactant may preferably be added to the surface of the polyamide yarn.

A process for making a tire yarn comprising applying to a synthetic polymeric yarn at least 0.05% based on the weight of the synthetic polymeric yarn, hydrophobic organic ester dip penetration regulator, preferably a polyol ester, more preferably a pentaerythritol ester or a triglyceride, preferably hydrogenated coconut oil, preferably at least 0.25% based on the weight of the synthetic polymeric yarn, having a melting point greater than 27° C. to the synthetic polymeric yarn wherein the tire yarn is convertible by conventional means into tire cord having low stiffness preferably less than 40 grams and more preferably less than 30 grams and high air permeability preferably at least 0.4 liter/30 min., more preferably at least 0.7 liter/30 min., has also been discovered. An ethoxylated nonionic surfactant 0.05–0.5% by weight based on the weight of the synthetic polymeric yarn is preferably applied to the synthetic polymeric yarn. An antioxidant 0.001–0.05% by weight based on the weight of the synthetic polymeric yarn is preferably applied to the synthetic polymeric yarn. The synthetic polymeric yarn is preferably polyamide yarn, preferably polyhexamethylene adipamide yarn.

The dip penetration regulator is applied to the synthetic polymeric yarn during yarn spinning, drawing, winding, or a post-winding operation. It can be applied by itself, with a diluent, or in combination with a finish. It is conveniently applied by adding it to a "spin" finish, and applying just after quenching and before the yarn is forwarded on the feed roll. A suitable "spin" finish typically contains 0–90 wt. % of a hydrophobic ester lubricant with a melting point below ambient temperatures, 0–95 wt. % of a nonionic surfactant, 0–5 wt. % of an antioxidant and, optionally, small quantities of other components. Typical nonionic surfactants include ethoxylated sorbitol and sorbitan fatty acid esters. When the dip penetration regulator of this invention is applied together with the "spin" finish, it can be applied as an aqueous emulsion at or above ambient temperatures, or as a neat oil above ambient temperatures. The dip penetration regulator can also be conveniently applied to the yarn as an "overlay" finish, after the yarn has been spun and drawn, immediately before winding. It can also be applied in a separate operation, after the spinning, drawing and winding operations; for example, in a rewinding or beaming operation. In the latter methods of application, it is convenient to apply the dip penetration regulator as a neat oil at temperatures above its melting point, but it can also be applied in emulsified form.

Typical synthetic yarns useful for this invention are polyamides, such as 6,6 nylon, 6 nylon and copolymers thereof, polyesters such as polyethylene terephthalate and copolymers thereof, aramids and polyvinyl alcohol. To meet the strength and durability requirements for tire applications, the yarns are normally prepared from high viscosity polymers containing stabilizers and are drawn at high draw ratios to yield high tenacity yarns. A typical process for preparing polyamide yarns with tenacities greater than 9 gpd, suitable for tire applications, is described in U.S. Pat. No. 3,311,691.

Synthetic polymeric tire yarns are converted to tire cords by a series of steps including: twisting of the singles yarn; cabling the twisted singles yarn to a tire cord; dipping the cord in a bath containing the reaction product of resorcinol, formaldehyde and latex (RFL) at ambient temperatures; and heating and stretching the RFL-containing cord to produce a strong, stabilized cord ready for rubber embedment. After cabling, it is common practice to weave the tire cord into fabric and dip and hot-stretch the fabric so produced. A wide range of cord compositions and structures are possible through the selection of yarn type and denier, denier per filament, twist level, number of plies, RFL composition, dip pick up, hot-stretching treating conditions, etc. Polyester and aramid tire cords or fabrics may require a pre-dip before the RFL dip in order to achieve acceptable adhesion.

When the yarns of this invention containing at least 0.05 wt. % dip penetration regulator based on the weight of yarn are processed into RFL-containing tire cords as described above, they were found to have surprisingly increased air permeability, as measured by wicking after rubber embedment, and sharply reduced stiffness. The improvements are significant with as little as 0.05 wt. % dip penetration regulator on yarn and are quite dramatic at higher levels of dip penetration regulator, such as 0.1 wt. % and above. Equally surprising is that the improvements in air permeability and stiffness are accomplished with little or no loss in the critical property of cord adhesion to rubber. The dip penetration regulator is believed to function by limiting the RFL dip penetration, during cord processing, to an area near the surface of the cord.

Low dipped cord stiffness eliminates problems in making uniform tight turn-ups since less force is required to bend carcass fabric plies around the bead, and there is little or no tendency for turn-ups to come loose. This is especially important where multiple carcass plies are turned up simultaneously. High dipped cord air permeability allows cords to dissipate trapped air and act as a reservoir, thereby eliminating curing blows.

TEST METHODS

For the testing of cord stiffness, cord wicking and cord adhesion, tire yarn samples were converted into tire cord by the process described in paragraph two for Control 1. The number of plies of yarn per cord varied with yarn denier. For yarns 1070 denier and above a 2-ply construction was used, wherein the singles yarn twist was 10, 'Z' tpi and the cable twist was 10 'S' tpi. For yarns less than 1070 denier a 3-ply construction was used, wherein the singles twist was 10 'Z' tpi and the cable twist was 10 'S' tpi.

Tire Cord Stiffness

Cord stiffness is a measure of the force, in grams, required to pull a sample of tire cord through a hole in a Teflon® polytetrafluoroethylene plate. A 2-inch unbent, unkinked sample of cord was centered and balanced horizontally in the hook on the end of a vertical wire which was inserted through a circular hole 1.0 cm in diameter in the center of a horizontal Teflon® plate (90×60×5 mm). The wire was slowly raised so that the cord was raised until it contacted the underside of the Teflon® plate. As the wire continued upward, the cord was bent at about its midpoint and pulled through the plate. The maximum force required to pull the cord through the plate was recorded. Ten samples per cord were averaged to give the stiffness in grams.

Wicking of Tire Cords

The test was conducted as described in ASTM Test D-2692-79 (pages 499–503; 1984 Annual Book of ASTM Standards, Section 7, Volume 7.01) with the following differences. Nitrogen was used, rather than air, as the gas which was wicked, and it was determined volumetrically, using a Precision Wet Test Meter (Precision Scientific Co., Chicago, Ill.) The molded sample size was the same as that of Test D-2692-79, but only a single layer of tire cords was used rather than two layers of fabric. Thus, each sample was comprised of: 2 layers of 6.4×89×3.2 mm rubber stock, a layer of 38×76×3.2 mm rubber stock, a layer of 20 tire cords, a layer of 38×76×3.2 mm rubber stock and 2 layers of 6.4×89×3.2 mm rubber stock. The 20 tire cords were laid in (zero tension) parallel to each other and to the edges of the 38 mm dimensions of the rubber stock; the cords were evenly spaced over a total distance of 50 mm, centered along the 76 mm dimension. The rubber stock employed was a combination of natural rubber (80 parts by weight), styrene-butadiene rubber (20 parts), N351 Black (35 parts), plus minor amounts of other conventional ingredients. After completing sample preparation in the mold, the rubber was cured in a press for 40 minutes at 150° C. with 20 tons (178 kN) pressure. The molded sample was then cooled to room temperature and trimmed as in D-2692 to expose fresh ends of the cord.

Wicking was determined by clamping the sample between the plates of the test chamber. After ensuring that there is no leakage around the edges of the sample, one side of the test chamber was pressured up to 100 psi (690 kPa) with nitrogen gas. Wicking was the amount of nitrogen in liters that passed along/through the tire cords in 30 minutes as recorded on the West Test Meter. Three molded samples were tested per tire cord and the results average. The wicking so determined is considered to be predictive of the air permeability of the tire cord in a tire.

Hot, Two-Ply Strip Adhesion Test

The test utilized was the same as ASTM Test D-4393-85, Strap Peel Adhesion of Reinforcing Cords or Fabrics to Rubber Compounds (pages 1133–1142; 1985 Annual Book of ASTM Standards, Section 7, Volume 7.01) with a few modifications. The particular variation used was to test individual tire cords, 1260 denier/2 ply, that had been RFL dipped singly. The rubber stock was the same formulation of natural rubber and styrene/- butadiene rubber described under the Wicking Test Method. The 1260/1/2 tire cords were warped at 36 ends/inch (vs. 24 in D-4393-85). After embedment of the cords in the rubber stock, the sample was cured at 160° C.+/−2° C. for 20 minutes at 62 kN pressure. Since hot adhesion was desired, the samples were heated in the Instron oven at 120° C.+/−2° C. for 25+/−5 minutes prior to testing. The separation force was based on Option 1 or the mid-line between the high and low peaks of separation force. Four samples per warp were tested and the results were reported as average force in pounds per inch.

EXAMPLES

Control 1

Freshly spun filament yarn of polyhexamethylene adipamide of 70 relative viscosity as measured in U.S. Pat. No. 2,385,890 and containing 64 parts per million copper as a stabilizer in the form of a cupric salt was two-stage drawn (5.2×), annealed (220° C.), relaxed (5–6%) and wound according to the process described in U.S. Pat. No. 3,311,691. Finish (1.2 weight percent based on weight of yarn) was applied to the yarn as a neat oil at about 75° C. via a kiss roll applicator located at the bottom of the spinning chimney, just before the feed roll; this is usually referred to as the "spin" finish. The "spin" finish was a mixture of four ingredients: 29 weight percent of a nonionic surfactant, a polyethoxylated oleate of sorbitan; 3 weight percent of a hindered phenolic antioxidant; 1 weight percent of a substituted polysiloxane; and 67 weight percent of hydrophobic organic ester lubricant, which is an unsaturated triglyceride derived from glyceryl trioleate, coconut oil and palm oil (melting point 21° C.). The tire yarn so produced was 1260 denier and contained 210 filaments. It had a typical tire yarn tenacity of 9.8 g/den. as measured with 3 tpi yarn twist.

The above tire yarn was converted into a conventional 2-ply 1260/1/2 tire cord (singles twist=10 'Z' tpi; cable twist=10 'S' tpi) and processed on a multi-end, 3-oven hot stretching unit using the following process parameters in ovens 1/2/3: temperature=138° C./room temperature/238° C.; exposure time=108/54/54 seconds; applied stretch=2.4/2.4/0.0%. Cords were passed through a resorcinol-formaldehyde-latex (D5A) dip (20% dip solids) before entering the first oven.

The dipped and stretched cord so prepared was characterized in terms of dip-pick-up (DPU), stiffness, wicking, and hot two-ply adhesion. See Table I for the data. Although an excellent tire cord in most respects, the cord was undesirably stiff (41 g.) and showed a low level of wicking (0.08 liters/30 min.).

EXAMPLE 1

This Example describes the preparation of polyhexamethylene adipamide tire cords which showed substantial advantages over Control 1 in terms of stiffness and wicking via "spin" finish modification.

Five different Samples, A–E, of polyhexamethylene adipamide tire yarns were prepared in the same manner as Control 1 above, except for the following differences in the spin finish: higher melting hydrophobic organic esters were substituted in place of the unsaturated triglyceride in all of the Samples (see Table II) and a mixture of polyethoxylated sorbitol fatty acid esters was used in Sample C as the nonionic surfactant in place of the polyethoxylated oleate of sorbitan. Two of the higher melting esters, hydrogenated coconut oil (mp 39° C.; Samples A–C) and pentaerythritol tetralaurate (mp 34° C.; Samples D–E), exemplify the kind of dip penetration regulators characteristic of this invention. Lower melting point coconut oil (mp 24°–27° C.) when used as the sole spin finish lubricant, without added dip penetration regulator does not produce the desirable results of this invention (see Control 2). Compositions of the finishes applied to the Sample yarns and to Control 1 yarn are given in Table II.

Sample tire yarns A–E were converted to tire cords in the same way as for Control 1; tire cord properties are given in Table I. From Table I, it can be seen that the relatively simple change in finish composition of the tire yarn to include at least a portion of hydrophobic organic ester dip penetration regulator with mp greater than 27° C. yielded rather dramatic changes in tire cord stiffness and wicking. Thus, the tire cord stiffness of Samples A–E ranged from 39 to 71% lower than that of Control 1, while wicking was 12.5 to 40 times greater than Control 1. Hot two-ply adhesion values for Samples A-E were about the same as that of Control 1.

EXAMPLE 2

This Example describes the preparation of polyhexamethylene adipamide tire cords with improved stiffness and wicking through the use of special "overlay" finishes.

Control 1 polyhexamethylene adipamide tire yarn, prepared as described above and containing 1.2% of the Control 1 "spin" finish given in Table II, was modified by applying the higher melting dip penetration regulators as "overlay" finishes in an off line process to the drawn, annealed and relaxed yarn. The higher melting dip penetration regulators used were hydrogenated coconut oil (mp 39° C.), Sample F, and pentaerythritol tetralaurate (mp 34° C), Sample G. Application of the "overlay" finish was effected by running Control 1 yarn through a slotted applicator to which the dip penetration regulator was metered as a neat oil at a temperature of about 70° C. The conditions were adjusted such that Sample F picked up 0.6 wt. % of hydrogenated coconut oil, while Sample G picked up 0.5 wt. % of pentaerythritol tetralaurate based on the weight of the yarn.

The tire yarns prepared as above were converted to tire cords in the same manner as Control 1 yarn. Cord properties are listed in Table I. Opposite Control 1, it can be seen that Samples F and G showed a marked decrease in cord stiffness of 46% and a dramatic increase in wicking of 9–24 fold.

EXAMPLE 3 AND CONTROL 2

Example 3 shows the beneficial effects of a very low level of a high melting dip penetration regulator on the stiffness and wicking of polyhexamethylene adipamide tire cord.

A polyhexamethylene adipamide tire yarn was prepared in the same way as Control 1, except that the "spin" finish was changed to the following composition: coconut oil (82 wt. %; mp=24°–27° C.), hindered phenolic antioxidant (3 wt. %), and sorbitan tristearate-20 ethylene oxide (15 wt. %); this yarn was Control 2. Another yarn was prepared in the same manner and with the same "spin" finish as Control 2, except that the coconut oil level in the finish was reduced to 77 wt. % and 5 wt. % of hydrogenated palm oil (mp 61° C.) was added; this yarn was Example 3. Example 3 and Control 2 were converted to tire cords and hot-stretched by procedures similar to those used for Control 1. Test results on the cords are given in Table III. It can be seen that, even with as little as 5 weight percent based on the weight of finish of a higher melting dip penetration regulator in the "spin" finish, such as hydrogenated palm oil, tire cord stiffness was reduced by 12%, wicking was noticeably increased and adhesion was not adversely affected.

TABLE I

| | Example | | | | | | | |
|---|---|---|---|---|---|---|---|---|
| | Control 1 | 1 | 1 | 1 | 1 | 1 | 1 | 1 |
| | Sample | | | | | | | |
| | — | A | B | C | D | E | F | G |
| Finish on yarn (wt. %) | 1.2 | 1.0 | 1.1 | 1.1 | 1.2 | 1.2 | 1.8 | 1.7 |
| Dipped Cords | | | | | | | | |
| Dip Pick-Up (wt. %) | 6.7 | 4.7 | 5.9 | 5.1 | 4.6 | 3.9 | 4.4 | 4.2 |
| Stiffness (g) | 41 | 21 | 21 | 18 | 25 | 12 | 22 | 22 |
| Wicking (liters/30 min.) | .08 | 2.1 | 2.2 | 2.4 | 1.0 | 3.2 | 1.9 | .7 |
| 120° C. 2-Ply Adhesion (lbs./in.) | 49 | 43 | 51 | 49 | 47 | 44 | 46 | 44 |
| Tenacity (gpd) | 7.2 | 7.9 | 8.2 | 7.7 | 7.8 | 8.0 | 7.9 | 7.5 |

TABLE II

| Spin Finish Composition (wt. % of component based on wt. of finish) | Example | | | | | |
|---|---|---|---|---|---|---|
| | Control 1 | 1 | 1 | 1 | 1 | 1 |
| | Sample | | | | | |
| | — | A | B | C | D | E |
| Non-Ionic Surfactants | 29 | 29 | 29 | 30 | 29 | 29 |
| Hindered Phenolic Antioxidant | 3 | 3 | 3 | 3 | 3 | 3 |
| Substituted Polysiloxane | 1 | 1 | 1 | — | 1 | 1 |
| Lubricant: | | | | | | |
| Unsaturated Triglyceride (mp = 21° C.) | 67 | — | — | — | — | — |
| Coconut Oil (mp = 24–27° C.) | — | — | 33 | — | 33 | — |
| Dip Penetration Regulator: | | | | | | |
| Hydrogenated Coconut Oil (mp = 39° C.) | — | 33 | 33 | 67 | — | — |
| Pentaerythritol Tetralaurate (mp = 34° C.) | — | 33 | — | — | 33 | 67 |

TABLE III

| | Control 2 | Example 3 |
|---|---|---|
| Finish on Yarn (wt. %) | 1.2 | 1.4 |
| Dipped Cords | | |
| Dip Pick-Up (wt. %) | 6.1 | 6.0 |
| Stiffness (g) | 42 | 37 |
| Wicking (liters/30 min.) | 0.00 | 0.20 |
| Hot (120° C.) 2-Ply Adhesion (lbs./in.) | 49 | 50 |

We claim:

1. A polyamide yarn suitable for use as a tire yarn characterized by a tenacity of greater than 9 g/den., a copper content of greater than 40 parts per million and having on the surface of the polyamide yarn at least 0.05% based on the weight of the polyamide yarn hydrophobic organic ester dip penetration regulator having a melting point greater than 27° C. selected from the group consisting of hydrogenated coconut oil, hydrogenated palm oil and pentaerythritol tetralaurate, whereby said yarn is convertible by conventional means into a tire cord having an air permeability as measured by wicking of at least 0.4 liters/30 min.

2. The polyamide yarn of claim 1 further characterized by the tire cord having a stiffness of less than 40 grams.

3. The polyamide yarn of claim 2 further characterized by having on the surface of the polyamide yarn 0.05–0.5% ethoxylated nonionic surfactant by weight based on the weight of the polyamide yarn.

4. The polyamide yarn of claim 2 wherein the air permeability is greater than 0.7 liter/30 min. and the stiffness is less than 30 grams.

5. The polyamide yarn of claim 4 wherein the polyamide yarn is polyhexamethylene adipamide yarn.

* * * * *